US007690654B2

(12) United States Patent
Vosper, Sr.

(10) Patent No.: US 7,690,654 B2
(45) Date of Patent: Apr. 6, 2010

(54) SYSTEM FOR PLAYING A COMBINATION BOARD AND CARD GAME

(76) Inventor: Michael E. Vosper, Sr., 2820 Cindy La., Charlottesville, VA (US) 22911

( * ) Notice: Subject to any disclaimer, the term of this patent is extended or adjusted under 35 U.S.C. 154(b) by 0 days.

(21) Appl. No.: 11/958,915

(22) Filed: Dec. 18, 2007

(65) Prior Publication Data

US 2009/0152814 A1 Jun. 18, 2009

(51) Int. Cl.
*A63B 67/06* (2006.01)

(52) U.S. Cl. ..... 273/271; 273/264; 273/267

(58) Field of Classification Search ..... 273/264, 273/267, 271
See application file for complete search history.

(56) References Cited

U.S. PATENT DOCUMENTS 3,512,779 A * 5/1970 McGaughey, Jr. ..... 273/275
3,565,439 A * 2/1971 Krouse et al. ..... 273/272
3,627,325 A * 12/1971 Breslow ..... 273/295
4,163,559 A * 8/1979 Stenstrom ..... 273/148 A
5,601,288 A * 2/1997 White et al. ..... 273/271
6,450,498 B1 * 9/2002 Rombone ..... 273/255
6,568,678 B2 * 5/2003 Breeding et al. ..... 273/149 R
7,175,522 B2 * 2/2007 Hartl ..... 463/11
2007/0035087 A1 * 2/2007 Guagliardo et al. ..... 273/243

* cited by examiner

*Primary Examiner*—William M Pierce
(74) *Attorney, Agent, or Firm*—Michael L. Greenberg, Esq.; Greenberg & Lieberman, LLC

(57) ABSTRACT

A card game combined with a board game. The object of the game, which can be played by at least two players, is to score the most points over the other competitors. A related aim of the game in this quest to achieve the highest points possible is to create horizontal, vertical, and diagonal placements of cards in the spirit and basics of tic-tac-toe.

1 Claim, 5 Drawing Sheets

SYSTEM FOR PLAYING A COMBINATION BOARD AND CARD GAME

FIELD OF THE INVENTION

The present invention relates to a playing card game rooted in the basic premise of scoring rules, combined with a method for applying this card game to a game board that adopts the basic principles of tic-tac-toe.

BACKGROUND OF THE INVENTION

Card games are very popular endeavors for people of all ages. These games range from relatively simple rules to complex. Card games like gin rummy, for example, comprise of detailed rules involving the formation of matched groupings and sequences of various cards featuring relevant suit or numerical categories. These games can stoke many levels of competition and also are fun to play.

As traditional card games have endured throughout the years, board games have adopted the use of cards. Many of these board games created their own cards to compliment the unique rules of those board games. For the majority of board games, standard cards featuring kings, queens, numbers and traditional suits remain relegated to varying forms of card games. In addition, there are few card games that combine decks of cards with the time-honored game of tic-tac-toe, and no games that combine these two classics with unique rules derived from tic-tac-toe and rummy scoring elements. Due to this fact, there is a unique need in the gaming market for a competitive endeavor featuring playing cards and a game applying basic tic-tac-toe properties to a game board.

Just as the case with playing cards, another fun game to play is the ever-popular tic-tac-toe. Tic-tac-toe, of course, is a game where players alternate placing either an "X" or "O" into one of nine spaces on a board or drawing shaped like a pound (#) symbol. The winner is the first player to achieve three symbols in a row. This can be done either horizontally, vertically or diagonally. Strategy ensues as players attempt to block the opposing player's three-in-a-row by using their own symbol. Tic-tac-toe is a competitive game that combines strategy with a little bit of luck. A fundamental problem with tic-tac-toe is that players often tie, resulting in a "cats" game. People often find this frustrating and the game can become boring and non-competitive after a time if each game continues to end in a tie. From this, we realize that there is a need to make the fun, competitive aspects of tic-tac-toe more competitive and exciting.

Meanwhile, rummy-type games have various forms. However, these games also combine competitive strategy with a bit of luck. Rummy-type games, whether it is gin rummy or another established variant, use a traditional 52-card playing deck. This playing deck includes the ace, king, queen, jack, and numbers 2 through 10. Each of these symbols of course comes in their designated suits of spades, hearts, diamonds and clubs. The object of the rummy-type games typically is for a player to dispose of all his or her cards through the processes of melding, discarding or laying off.

There is no question that people enjoy trying their hand at rummy-type card games. The competition, strategy and luck are only a few elements that drive competitors to get together and play. Moreover, people also enjoy competing against each other in tic-tac-toe. Tic-tac-toe, until players get frustrated at the constant "cats" games, can be addicting and fun as people attempt different strategies relating to the placement of their "X" or "O". A third popular item is the long-revered board game. Friends and families play board games for fun and competition. Board games come in all shapes, sizes and rules. But none of these board games combines tic-tac-toe elements with rummy-type scoring aspects for a competitive, fun game.

The present invention satisfies the need in the game market by presenting a board game featuring unique rules derived from the basic elements of a rummy-type card game in terms of scoring, as well as tic-tac-toe without the frustrating "cats" games. The present invention features unique rules and also permits more than two players to be involved, which is contrary to traditional tic-tac-toe rules.

U.S. Pat. No. 6,547,247 issued to Hoyt et al on Apr. 15, 2003, is a playing card game that applies a standard playing card deck to achieve various objectives between competing players. Hoyt combines the rules of tic-tac-toe with the card games of "21" and "poker." Unlike the present invention, Hoyt features its own set of rules that permit victory by using a set number of cards from the full deck in order to achieve the closest to number 21 while placing cards horizontally, vertically or diagonal. Moreover, Hoyt limits itself to this, as well as U.S. Pat. No. 7,118,113 issued to Hoyt et al on Oct. 10, 2006, by applying the rules of 21 to a tic-tac-toe board and does not consider the unique rules relating to scoring and engaging method of competition as does the present invention.

U.S. Pat. No. 5,655,773 issued to Marks on Aug. 12, 1997, is a tic-tac-toe playing board that implements numerical cards to assist in the process. Unlike the present invention, Marks does not apply the elements of scoring and engaging method of competition, as does the present invention.

U.S. Pat. No. 5,248,149 issued to Tarrats on Sep. 28, 1993, is a method of playing tic-tac-toe through the use of cards. Unlike the present invention, Tarrats does not involve elements of scoring or much more engaging method of competition, and instead implements cards that feature "X" and "O" symbols for use in the tic-tac-toe play.

While tic-tac-toe is as popular as board games and card games, there is nothing out there that effectively combines all three. Because of this, there remains a need for a game that plays off the basic premises of both tic-tac-toe and rummy-type card games in terms of scoring to create an engaging, fun and competitive game. The present invention satisfies this need by taking the basics from rummy-type scoring games and tic-tac-toe and combining them into a unique board game with its own novel set of rules and objectives. The present invention thus eliminates "cats" games in regard to tic-tac-toe while permitting at least two players to compete in not only tic-tac-toe, but also in a game of cards and a board game.

SUMMARY OF THE INVENTION

The present invention is essentially a card game combined with a board game. The object of the game, which can be played by at least two players, is to score the most points over the other competitors. A related aim of the game in this quest to achieve the highest points possible is to create horizontal, vertical, and diagonal placements of cards in the spirit and basics of tic-tac-toe. In the preferred embodiment, the horizontal placement of cards are called "tics," vertical placement of cards are called "tacs," diagonal placement from upper left to lower right is called a "rum," and the diagonal placement from upper right to lower left is called "mee." Of course the names can be changed or omitted in other embodiments.

Eventually, players will have covered the game board and its spaces with game cards that have been strategically placed based on assigned values and numbers. Points are awarded to a specific player during his or her turn when all remaining spaces on the game board are covered. These spaces would have to be within incomplete horizontal, vertical, or diagonal patterns. Strategy ensues because only that specific player who completes a pattern will earn points as opposed to another specific player who merely lays playing cards onto the game board or its corresponding spaces without the full completion of that pattern. After the points are awarded to a specific player, those cards are removed from the game board and placed in a separate pile out of play. This general process of the present invention continues until all the cards from all the players make all the possible patterns.

A related aspect of the present invention is that players are competing to build the game board and its spaces with the game cards. This requires the building of foundations, corners—F1 and F2 cards, and center—F3—cards of the game board to create the horizontal, vertical and diagonal patterns. In other words, players cannot put a game card down until they build a corner, side or center section of the game board based on their card draw and strategy relating to such aspects as point value. But once that corner, side or center section is "built" with a combination of "F" cards along with the potential use of "wild" cards, the game board can continue to be completed.

The present invention involves two distinct stages. The first stage involves the use of a point deck as point values and other events begin that serve to set up the actual playing and scoring elements of the second stage.

The present invention begins with the use of a point deck. This point deck contains seven numerical cards ranging from 1-7. In addition, each player takes possession of a full, 52-card deck of game cards. Each deck includes four wild cards, four F1 cards, four F2 cards and four F3 cards. Additional embodiments of the present invention can make use of traditional playing cards. What happens first is that each player chooses a card from the point deck with the numbers facing away from their field of vision. The player who chooses the highest numerical card in this point deck of numbers 1-7 becomes the honors player. Play moves around clockwise from the honors player. All cards are then returned to the point deck and the point deck is shuffled. The honors player then chooses a card from the point deck with the numbers facing away from the field of vision. This card from the point deck will be deemed the value card and is set-aside in full view.

This is where the players turn to their full, 52-deck of game cards. Each player removes the four wild cards and at least one F1 card, F2 card and F3 card. In the preferred embodiment, each of the four wild cards has a "tic," a "tac," a "rum" or a "mee" on it. The remaining game cards from the 52-card decks are set aside and the extracted seven cards are shuffled and each player chooses a card where the face side is pointed away from their field of vision. What has happened is that each player is in possession and in full view of one card obtained from his or her individual extracted seven cards (the earlier extracted wild cards and F cards are not a factor at this point.) In addition, the honors player also is in possession of the value card taken from the point deck. The value card serves to establish a value for point scoring relating to the one card obtained from the extracted seven cards of each player. This means that if, for example, the value card is 7, and player two had chosen an F2 card and player three had chosen a wild card with a "rum" on it from the extracted cards, then the F2 card will be valued at 7 and the "rums"—left upper to lower right diagonals—will instead be valued at 7 for the duration of the game. This same procedure will continue by using the point deck to add values to the remaining F cards, as well as the four wild cards. At this point, the point deck is no longer needed and all cards from the point deck can be set aside. Moreover, each 52-card deck is shuffled with all 52 cards, including those cards that had been extracted.

This leads the present invention into its second phase dealing with actual playing and scoring. All players then draw eight cards from their full, 52-card deck that is face down. Upon extracting these eight cards, the players can view the cards but keep them hidden from the view of the other players. The honors player goes first and draws an additional $9^{th}$ card from his or her full deck. The honors player then can place cards onto the game board or in the spaces in an effort to score points. For example, if the honors player has an F1 card and an F2 card, or a wild card, as well as a 9 card, the honors player can build a foundational element of the game board in the bottom right corner. An aspect of the present invention is that the abutting F cards must be placed before a numerical card can be placed in its corresponding space. So, if the honors player places three cards onto the game board, he or she must then draw three replacement cards from the full deck. The honors player may then play those cards if possible. If the honors player had enough proper cards, including wilds if necessary, to place the F1, F2 and F3 cards along the bottom portion of the game board, as well as card 7 card 8 and card 9 in those corresponding spaces along the bottom, then the honors player would earn the points for creating the horizontal pattern akin to tic-tac-toe. In the preferred embodiment, this also would be called a "tic." The honors player also would earn points for the F1, F2 and F3 cards he or she added. After that turn is completed and there are no more plays for the honors player, he or she must choose a card to discard from his or her drawn cards, and place it at the bottom of the individual, full deck. The horizontal pattern would then be removed and set aside out of play, but the F1, F2 and F3 cards would remain. At this point, the next player goes through the same process. If in the above example, the honors player placed a good foundation at the bottom of the game board but failed to, for example, place an 8 card in its requisite space, the next player may place that card in the space if he or she is in possession of that card. If that happens, that player will earn the points for the horizontal pattern instead of the honors player. This is a fundamental part of the strategy of the present invention. Moreover, since a score sheet is used to keep score and track values relating to the point card process, players may also strategize regarding point values relating to these point card established values unique to each player.

DETAILED DESCRIPTION OF THE PREFERRED EMBODIMENT

I. The Parts

Figure 1:
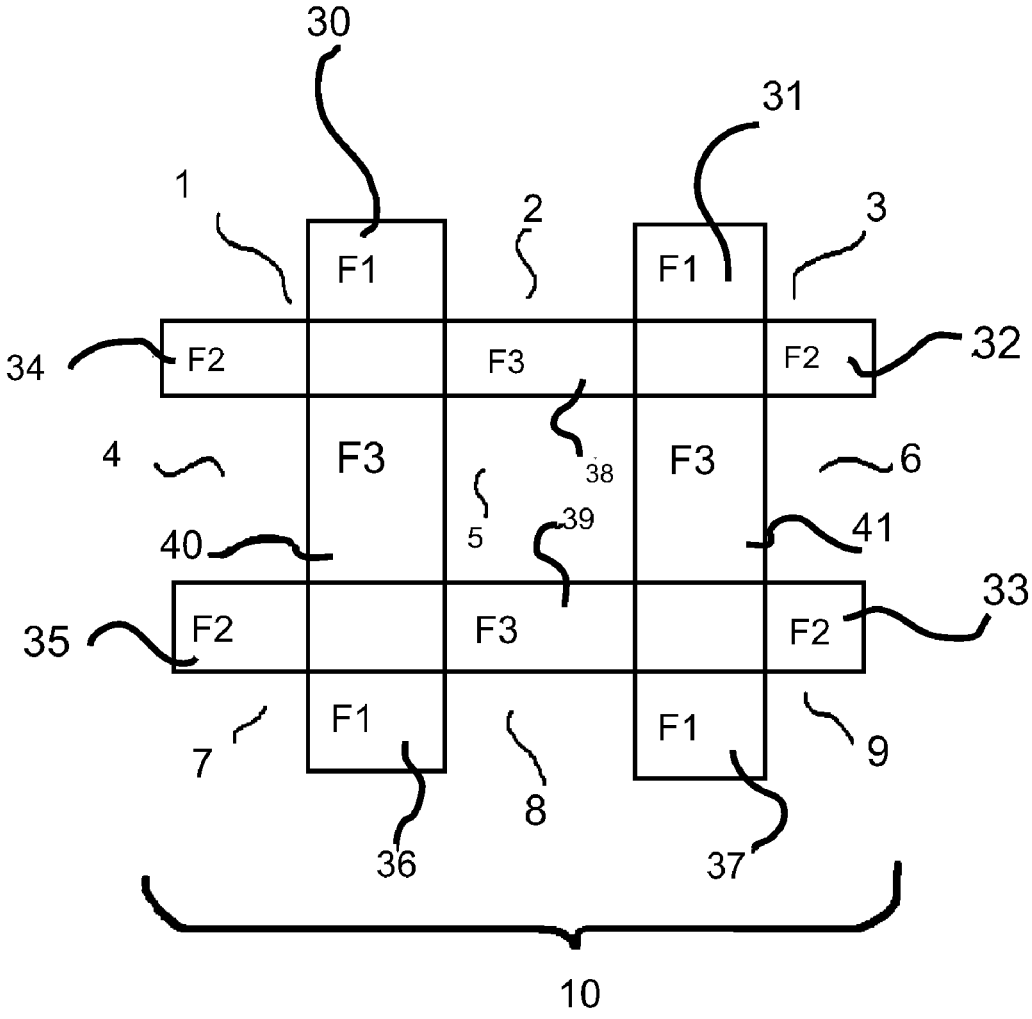
FIG. 1 is a view of an embodiment of the game board (10) of the present invention.

The present invention is essentially a card game combined with a board game that adopts elements of tic-tac-toe and the scoring aspects of such card games as rummy. At least two players may participate. In FIG. 1, we see an embodiment of the game board (10). In the preferred embodiment as we see in FIG. 1, the game board (10) has the appearance of a tic-tac-toe game. In other words, this embodiment of the present invention as seen in FIG. 1 is similar in shape to a pound (#) symbol.

Figure 2:
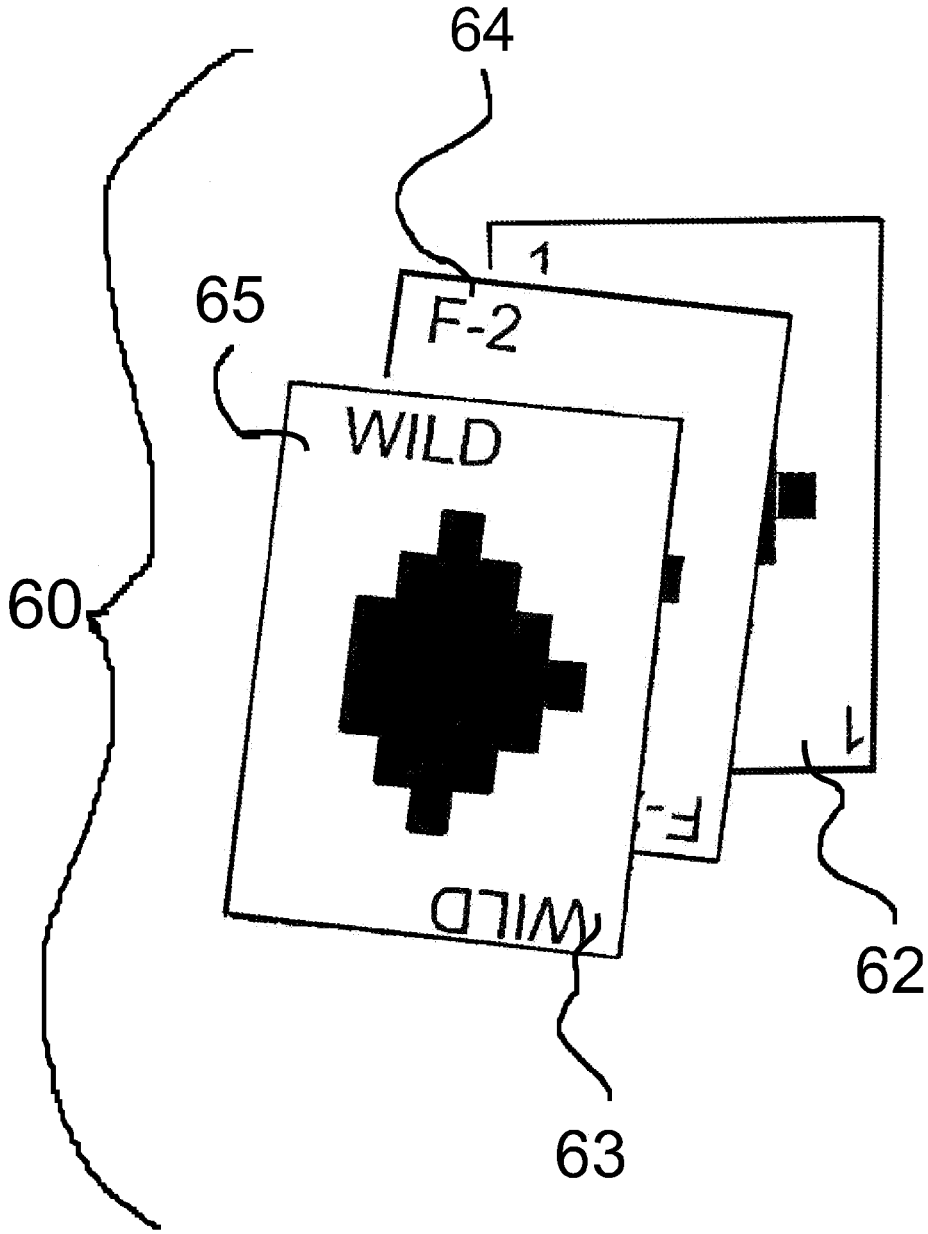
FIG. 2 is a view of an example playing card from the full, 52-card deck of playing cards.

The embodiment of the game board (10) as seen in FIG. 1 consists of 16 individual boxes, 12 of which are playable. These 12 playable boxes are referred to as foundation boxes (30, 31, 32, 33, 34, 35, 36, 37, 38, 39, 40, 41). However, it is important to note that this is merely one embodiment of the present invention and adaptations featuring additional or less squares also may be possible. But as we see in FIG. 1, the 12 foundation boxes (30, 31, 32, 33, 34, 35, 36, 37, 38, 39, 40, 41) of the game board (10) display an F1, F2, or F3. The foundation boxes (30, 31, 32, 33, 34, 35, 36, 37, 38, 39, 40, 41) are the locations on the game board (10) where playing cards as seen in FIG. 2 may be placed in conjunction with the corresponding number.

As seen in FIG. 1, this is relevant for the upper F1 portion (30, 31) of the game board (10), lower F1 portion (36, 37), right F2 portion (32, 33), left F2 portion (34, 35), horizontal F3 portion (38, 39) and vertical F3 portion (40, 41). The upper F1 portion (30, 31) and the lower F1 portion (36, 37) each contain two foundation boxes where F1 cards may be placed. Regarding the right F2 portion (32, 33) and the left F2 portion (34, 35), these also contain two foundation boxes each where F2 cards may be placed. Relating to the horizontal F3 portion (38, 39) and vertical F3 portion (40, 41), these also contain two foundation boxes each where F3 cards may be placed.

In FIG. 1, we also see 9 playable spaces (1-9). Each of these playable spaces can fit a numerical card from the 52-card deck (60) of FIG. 2. Only the corresponding number is permitted to be placed in its corresponding space. Card numbered 1 from the 52-card deck (60) may only be placed in numerical space 1 (1). Card numbered 2 from the 52-card deck (60) may only be placed in numerical space 2 (2). Card numbered 3 from the 52-card deck (60) may only be placed in numerical space 3 (3). Card numbered 4 from the 52-card deck (60) may only be placed in numerical space 4 (4). Card numbered 5 from the 52-card deck (60) may only be placed in numerical space 5 (5). Card numbered 6 from the 52-card deck (60) may only be placed in numerical space 6 (6). Card numbered 7 from the 52-card deck (60) may only be placed in numerical space 7 (7). Card numbered 8 from the 52-card deck (60) may only be placed in numerical space 8 (8). Card numbered 9 from the 52-card deck (60) may only be placed in numerical space 9 (9).

A general rule in the present invention is that a numbered card from the 52-card deck (60) may only be placed on its corresponding numerical space (1-9) only after the foundation boxes (30, 31, 32, 33, 34, 35, 36, 37, 38, 39, 40, 41) that touch the particular numerical space (1-9) are covered by an F card of the same number as that on the particular foundation box (30, 31, 32, 33, 34, 35, 36, 37, 38, 39, 40, 41). For example, if a player wants to place card number 9 from the 52-card deck (60), a foundation card, or F card, must already be placed on the bottom right F2 box (42) that is situation at the lower end of the right F2 portion(32, 33) and the bottom right F1 box (37) that is situated at the lower F1 portion(36, 37). Because both the bottom right F2 box(42) and bottom right F1 box (37) are the only foundation boxes that touch the numerical space 9 (9), the card numbered 9 from the 52-card deck (60) may be placed in the numerical space 9 (9) once those touching spaces are also covered by the corresponding cards. In another example, a corresponding card to numerical space 5 (5) can only be placed once all the foundation boxes touching this space are covered. In the case of numerical space 5 (5) it is the horizontalF3 portion(38, 39) and the verticalF3 portion(40, 41).

The game board (10) as seen in FIG. 1 can be made of any durable material connected and crafted by conventional means, but also may even consist of merely a drawing, although a physical game board (10) as seen in FIG. 1 is the more desired embodiment.

As mentioned above, FIG. 2 shows us an embodiment of a 52-card deck (60) with a playing card (65) on top. The playing card (65) is two sided and similar to a traditional playing card in that the backside prevents all players from seeing what is displayed on the front side of the playing card (65). The front side of the playing card (65) that comes from the 52-card deck (60) features at a minimum a number (62), a wild card indicator (63), or an F1, F2 or F3 indicator (64). Each 52-card deck (60) contains 4 wild cards, four F1 cards, four F2 cards, four F3 cards, four 1s, four 2s, four 3s, four 4s, four 5s, four 6s, four 7s, four 8s, and four 9s. These all add up to 52 cards. Each number (62), wild card indicator (63), or F1, F2 or F3 indicator (64) at the front side of the playing card (65) as seen in FIG. 2. In the preferred embodiment, each of the four wild cards has a "tic," a "tac," a "rum" or a "mee" displayed on it.

As mentioned above, each 52-card deck (60) includes four wild cards. Just as wild cards in traditional card games such as poker stand in for the usual value of a certain card, wild cards in the present invention serve as strategic replacements to fill a numerical space or foundation space on the game board (10). This means that if a player wishes to place an F2 card onto the game board but does not have an actual F2 card, he or she can substitute the F2 card with a wild card.

The number of actual 52-card decks (60) that are included in the present invention depend on the number of players. If there are four players, for example, then four 52-card decks (60) would be used that consist of the same elements.

Figure 3:
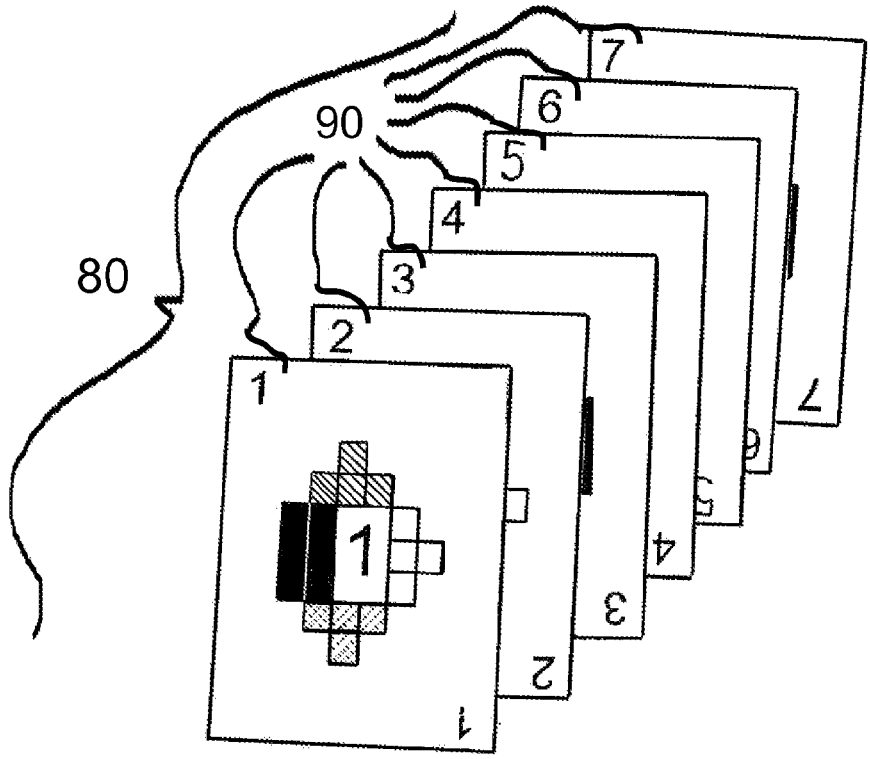
FIG. 3 is a view of an example point card from the point deck.

The present invention also includes a point deck (80) as seen in FIG. 3. Unlike the 52-card decks (60) as seen in FIG. 2, the present invention only requires one point deck (80). The point deck (80) consists of only seven cards. These are numerical cards displaying the numbers 1, 2, 3 4, 5, 6 and 7 on the front side in point card numerical indicators (90). Like traditional playing cards, the backside prevents players from viewing the numbers displayed on the front side.

Figure 4:
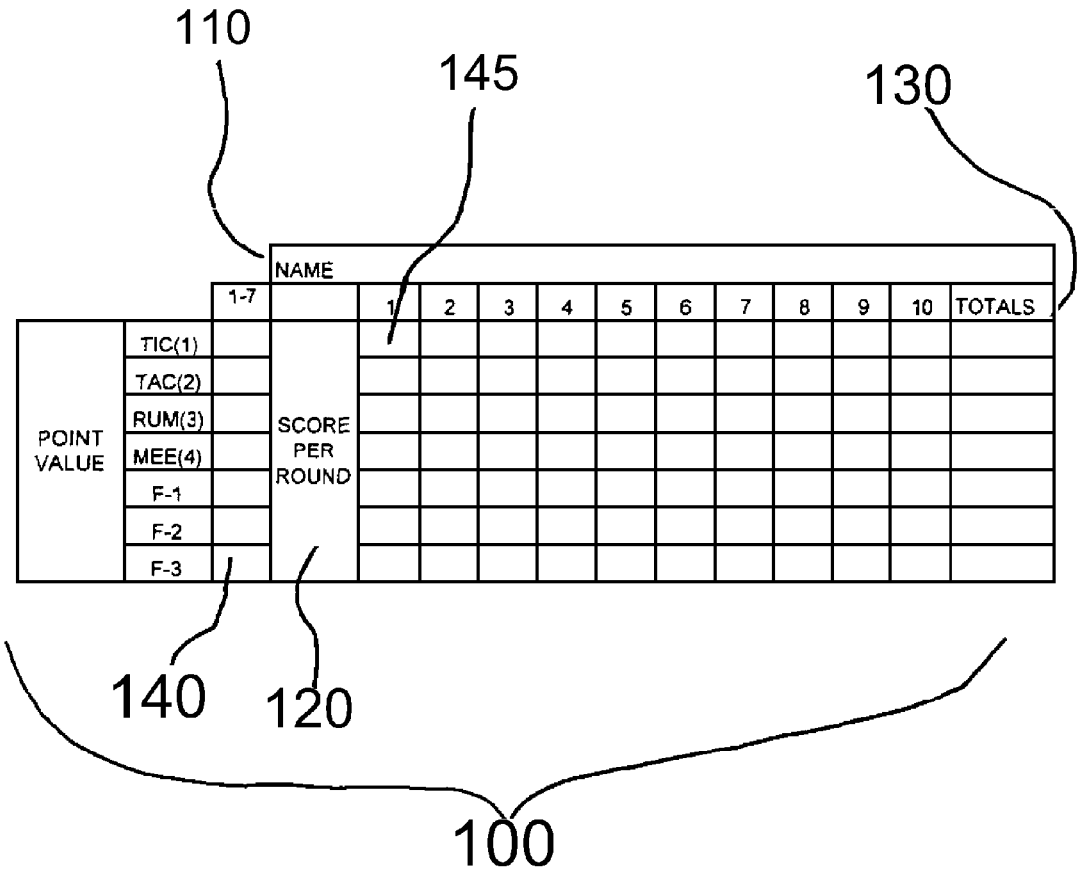
FIG. 4 is a view of a scoring sheet (100) of the present invention.

FIG. 4 shows us an embodiment of a scoring sheet (100) for the present invention. The score sheet (100) is used to tally up the points awarded to each player after each round. The winner is the player with the highest number of points at the conclusion of the game. The conclusion occurs when all the numerical cards from each of the full, 52-card decks (60) are placed onto the game board (10), leaving some players in possession of foundation cards. In the preferred embodiment, the scoring sheet (100) includes a space for player name (110), score per rounds (120), total score (130) and first round point values (140) ranging from the wild cards and F cards. Score for additional rounds (145) also are tallied. Each player may receive a blank, identical scoring sheet (100) in the preferred embodiment.

II. The Method of Play

Figure 5:
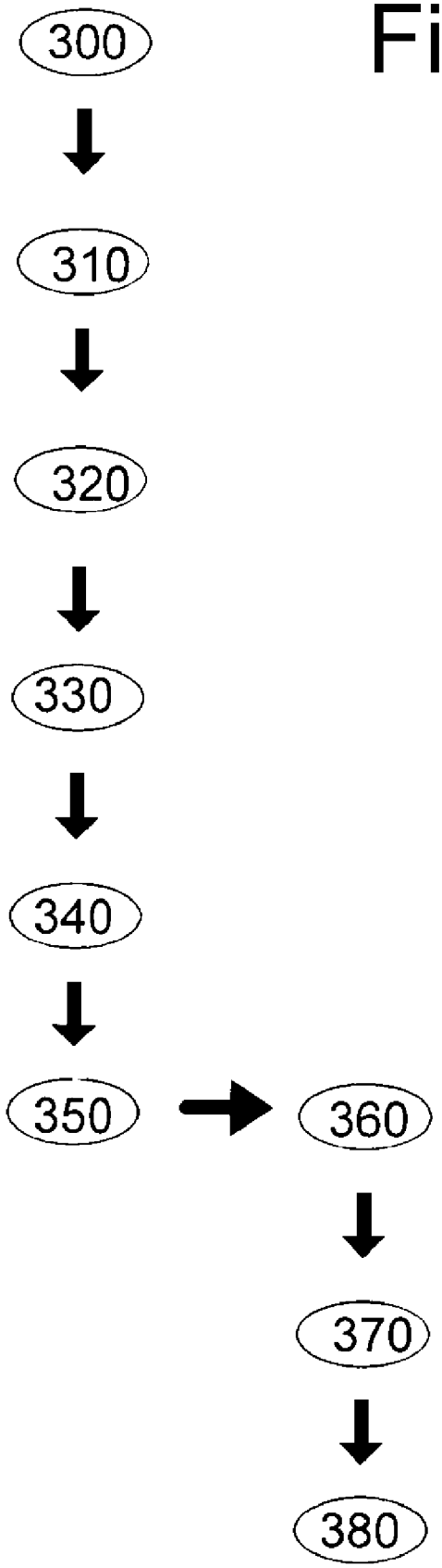
FIG. 5 is a flow chart of the method of the present invention.

In FIG. 5, we see a flow chart detailing the primary steps in applying the method of the present invention. The ultimate goal of the present invention from the perspective of the players is to score the most points. The present invention involves two distinct stages. The first stage involves the use of the point deck (80) as point values and other events begin that serve to set up the actual playing and scoring elements of the second stage.

What happens first is that each player chooses a card from the point deck (300) with the numbers facing away from their field of vision. The player who chooses the highest numerical card in the point deck (80) of numbers 1-7 becomes the honors player. In the preferred embodiment, play moves around clockwise from the honors player. All cards are then returned to the point deck and the point deck is shuffled (310). The honors player then chooses another card from the point deck (320) with the numbers facing away from the field of vision. This card from the point deck will be deemed the value card and is set-aside in full view.

This is where the players turn to their full, 52-deck (60) of game cards. Each player removes the four wild cards and at least one F1 card, F2 card and F3 card (330). As mentioned above, the preferred embodiment has each of the four wild cards displaying "tic," "tac," "rum," and "mee." The remaining game cards from the 52-card deck (60) are set aside and the seven extracted cards are shuffled and each player chooses a card (340) where the face side is pointed away from their field of vision. What has happened is that each player is in possession and in full view of one card obtained from his or her extracted seven cards (the earlier extracted wild cards and F cards) taken from the individual 52-card deck (60). In addition, the honors player also is in possession of the value card taken from the point deck (80). The value card serves to establish a value for point scoring relating to the one card obtained from extracted seven cards taken from the individual 52-card deck (60) of each player. This means that if, for example, the value card is 7, and player two had chosen an F2 card and player three had chosen a wild card with a "rum" on it taken from the extracted seven cards of the individual 52-card decks, then the F2 card will be valued at 7 and the "rum" cards—left upper to lower right diagonals—will instead be valued at 7 for the duration of the game. This same procedure will continue by using the point deck (80) to add values to the remaining F cards and run cards, which are considered in the preferred embodiment as "tics," "tacs," "rums," and "mees." At this point, the point deck (80) is no longer needed and all cards from the point deck (80) can be set aside. Moreover, each 52-card deck (60) is shuffled with all 52 cards, including those cards that had been extracted.

This leads the present invention into its second phase dealing with actual playing and scoring. All players then draw eight cards from their full, 52-card deck (350) that is face down. Upon extracting these eight cards, the players can view the cards but keep them hidden from the view of the other players. The honors player goes first and draws an additional $9^{th}$ card from his or her full deck (360). The honors player then proceeds to place cards onto the game board (370) or in the spaces in an effort to score points. For example, if the honors player has an F1 card and an F2 card, or a wild card, as well as a 9 card, the honors player can build a foundational element of the game board in the bottom right corner. An aspect of the present invention is that the abutting F cards must be placed before a numerical card can be placed in its corresponding space. So, if the honors player places three cards onto the game board, he or she must then draw three replacement cards from the full deck. The honors player may then play those cards if possible. If the honors player had enough proper cards, including wilds if necessary, to place the F1, F2 and F3 cards along the bottom portion of the game board, as well as card 7, card 8 and card 9 in those corresponding spaces along the bottom, then the honors player would earn the points for creating the horizontal pattern akin to tic-tac-toe. In the preferred embodiment, this would also be called a "tic." The honors player would also earn points for the F1s, F2s and F3 cards he or she added. Other possible patterns include a vertical pattern and a diagonal pattern. After that turn is completed and there are no more plays for the honors player, he or she must choose a card to discard from his or her drawn cards, and place it at the bottom of the individual, full deck. In the preferred embodiment, the horizontal pattern—"tic"—would be removed and set aside out of play, but the F1s, F2s and F3 cards would remain.

After the honors player completes his or her turn, the next player repeats the process (380). If in the above example, the honors player placed a good foundation at the bottom of the game board but failed to, for example, place an 8 card in its requisite space, the next player may place that card in the space if he or she is in possession of that card. If that happens, that player will earn the points for the horizontal patter instead of the honors player. The same goes for diagonal patterns and vertical patterns. This is a fundamental part of the strategy of the present invention. Moreover, since a score sheet (100) is used to keep score and track values relating to the point card process, players may also strategize regarding point values relating to these point card established values unique to each player.

An embodiment of the present invention makes use of wild cards. As mentioned above, four wild cards are included in each full, 52-card deck (60). When wild cards are used as substitutes for the foundation cards, or F cards, the wild cards may remain as long as the player who places the wild card wishes. In this embodiment, that player also may replace the wild card with this actual F card as it becomes available and maintain possession of the wild card. This is done as a strategic method of obtaining the highest number of points to mark in the score sheet (100).

An additional but preferred embodiment of the present invention typically occurs after one or two rounds of this second phase. At this point, much of the foundation of the game board (10) will be filled up and points allocated on the score sheet (100). Numerical cards will be stacked onto the game board (10), leaving players drawn with a number of foundation cards. Players can then hold these cards and "pass" their turn. Once a player has nothing left but foundation cards, the player will lay down the cards and wait for the other players to conclude the game. As mentioned in regard to FIG. 4, scores from each round are tallied on the score sheet (100) and the player with the highest point total wins.

It should be understood that only the preferred embodiment(s) have been described, and that the invention is any and all embodiments within the scope of the following claims.

I claim:

1. A game method, comprising:

using a board with a # shape, the board containing at least 12 boxes but no more than 16 boxes;

placing cards from a deck of playing cards onto the board, the cards from the deck of playing cards displaying distinctive markings;

extracting value to a wild value, while also extracting numerical value to the cards that are not wild, and matching distinctive markings on at least 12 boxes of the board;

drawing cards from the deck of playing cards and attempting to place the cards with the distinctive markings onto corresponding markings of the board in as much of a foundational pattern as possible beginning with one corner of the board;

placing the cards with the distinctive markings onto corresponding markings of the board before a card with a numerical value is placed into an adjacent area of the board;

earning points relating to point values from placement of the cards that had been placed during each turn in designated patterns;

allowing the wild value to serve as a substitute for the cards displaying the distinctive markings;

recording points earned by each player on a scoring sheet;

displaying a number having a value on the deck of point cards;

choosing a card from the deck of the point cards at a beginning of a game;

deeming the player who chooses the highest valued card from the deck of the point cards as an honors player; and having the honors player choose an additional card from the deck of the point cards, with the number of the additional card representing point values for the rest of the game.

* * * * *